United States Patent [19]

Watmough et al.

[11] 4,043,808

[45] Aug. 23, 1977

[54] STEEL ALLOY

[75] Inventors: Thomas Watmough, Dolton; Robert P. O'Shea, Lombard, both of Ill.

[73] Assignee: The United States of America as represented by the Secretary of the Air Force, Washington, D.C.

[21] Appl. No.: 282,082

[22] Filed: Aug. 14, 1972

[51] Int. Cl.[2] ..... C22C 38/02; C22C 38/04; C22C 38/24

[52] U.S. Cl. ..... 75/126 E; 75/126 K; 148/36

[58] Field of Search ..... 75/126 R, 126 K, 123 R, 75/126 E; 148/36

[56] References Cited

U.S. PATENT DOCUMENTS

| | | | |
|---|---|---|---|
| 1,831,946 | 6/1930 | Breeler | 75/126 K |
| 1,979,015 | 10/1934 | Schulz | 75/126 K |
| 2,182,759 | 12/1939 | Harder | 75/126 K |
| 2,186,758 | 1/1940 | Krause | 75/126 K |
| 3,424,576 | 1/1969 | Fogelman et al. | 75/123 J |

OTHER PUBLICATIONS

Metals Handbook, ASM, Metals Park, Ohio, 1961, p. 61.

Clark, D. S. et al., Physical Metallurgy for Engineers, Van Nostrand, Princeton, 1962, p. 129.

*Primary Examiner*—Richard E. Schafer

*Attorney, Agent, or Firm*—Joseph E. Rusz; William J. O'Brien

[57] ABSTRACT

A medium carbon low alloy steel which utilizes phosphorus as an essential alloying ingredient to control and manipulate the fragment mass distribution characteristics of an exploding steel alloy warhead.

3 Claims, 11 Drawing Figures

STEEL ALLOY

BACKGROUND OF THE INVENTION

This invention relates to a medium carbon low alloy steel having phosphorous as an essential alloying ingredient. In a more particular aspect, this invention concerns itself with the utilization of phosphorus to control the fragmentation characteristics of medium carbon steel alloys used in making explosive warheads.

The proper selection of various alloying parameters provides the means for controlling fragmentation characteristics and makes certain steel alloys useful in the manufacture of warheads for use against military targets. Certain steel alloys, therefore, find utility as a structural material in the manufacture of antipersonnel grenades, warheads for both light and heavy artillary shells, and aerial bombs where fragmentation is of primary concern.

In attempting to improve fragmentation characteristics and provide a more desirable warhead material, it has been found that the addition of phosphorus as an alloying ingredient to medium carbon low alloy steels improves their fragmentation characteristics in an unexpected manner. Phosphorous addition has been found to be one of the primary factors responsible for the improved fragmentation achieved by the alloys of this invention. However, the manipulation of hardness, grain size and temper embrittlement are also important in controlling the fragment mass distribution emanating from an exploding warhead. The manipulation and control of the above factors, as well as the compositional content of the alloy, provides a material that exhibits a high fragment mass distribution upon detonation of a warhead fabricated from that material.

SUMMARY OF THE INVENTION

In accordance with the broad concept of this invention, it has been found that the manipulation and control of the compositional content of medium carbon low alloy steels can provide a structural material that exhibits a high degree of fragmentation when the meterial is used in the fabrication of explosive warheads. In has been found that the incorporation of phosphorus, as an essential alloying ingredient, in the low alloy steels contemplated by this invention provides the primary degree of control over their fragmentation characteristics. The manipulation of hardness, grain size and temper embrittlement also contribute to the high degree of fragmentation characterized by the steel alloys of this invention, but proper phosphorus content is essential if desirable fragmentation is to be achieved.

Accordingly, the primary object of this invention is to provide a medium carbon low alloy steel that possesses high fragmentation characteristics.

Another object of this invention is to provide a steel alloy whose fragmentation characteristics are controlled by the addition of phosphorus to its compositional content.

Still another object of this invention is to provide a steel alloy that possesses the necessary amounts of phosphorus together with hardness, grain size and embrittlement characteristics required to control the fragment mass distributionemanating from the detonation of a steel alloy warhead.

A further object of this invention is to provide a structural material that possesses the fragmentation characteristics that make it especially useful in the production of antipersonnel and antivehicle warheads for use against both light and heavy targets.

The above the still further objects and advantages of the present invention will become more readily apparent upon consideration of the following detailed description thereof when taken in conjunction with the following drawings.

DESCRIPTION OF THE PREFERRED EMBODIMENTS

The fragmentation alloys of this invention are medium carbon low alloy steel compositions. Primarily, the addition of phosphorus, as an essential alloying ingredient, is the principle controlling factor in providing for an alloy that possesses the high degree of fragmentation achieved by the invention. The manipulation of hardness, grain size, and temperature embrittlement of the steel alloy is also utilized to control the fragment mass distribution emanating from a warhead made from such alloys. In testing the concept of this invention, a medium carbon low alloy steel was selected to shown the influence of the above manipulations on fragment mass distribution. The compositions of the alloys tested are given in Table I.

TABLE I

| Element | Composition of Steel Alloy in Weight percent |
|---|---|
| C | 0.5 |
| Mn | 1.5 |
| Cr | 1.5 |
| V | 0.15 |
| Si | 0.4 |
| P | 0.029 to 0.082 |
| Fe | balance |

The alloys of Table I were made hardened and tempered in accordance with conventional techniques at tempering temperatures of 850° F, 925° F, and 1100° F. These temperatures provided the necessary degree of hardness, grain size and embrittlement needed to control the fragment mass distribution.

Figure 1:
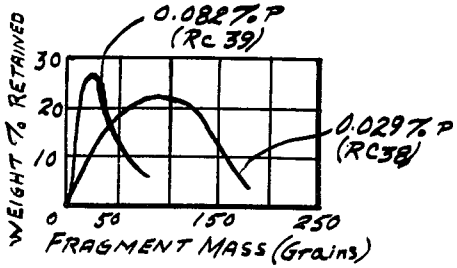
FIGS. 1 to 8 are graphical representations showing the effects of phosphorus content on the fragmentation characteristics of the steel alloys of this invention.
Figure 2:
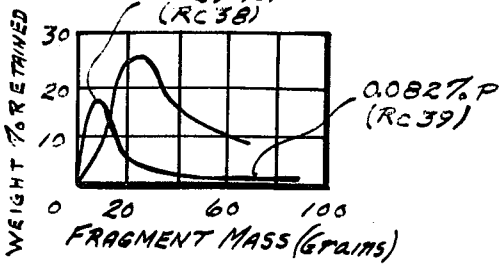
Figure 3:
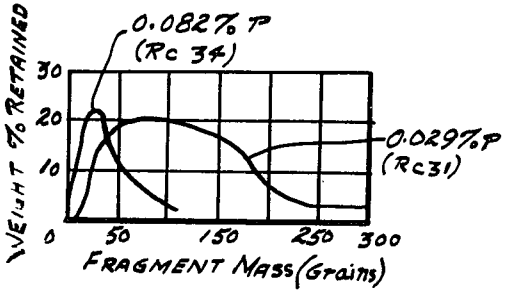
Figure 4:
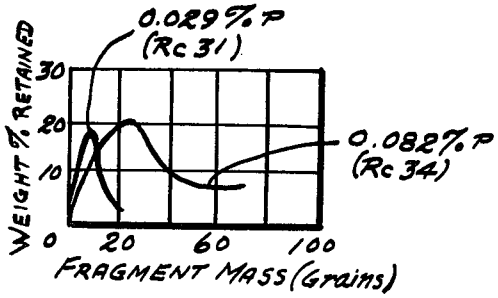
Figure 5:
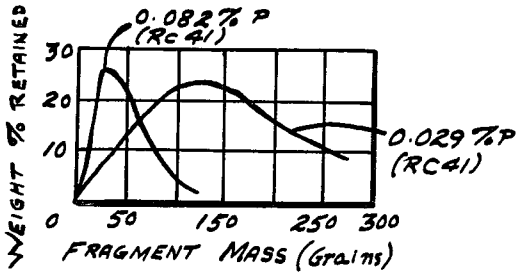
Figure 6:
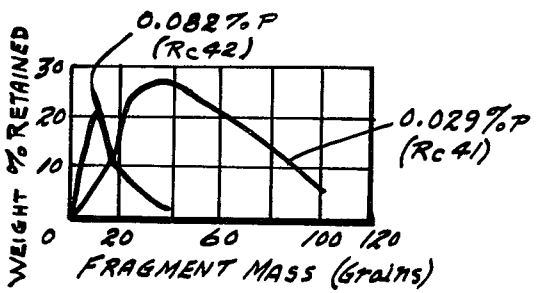
Figure 7:
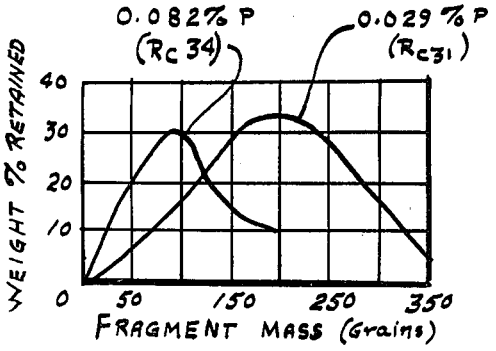
Figure 10:
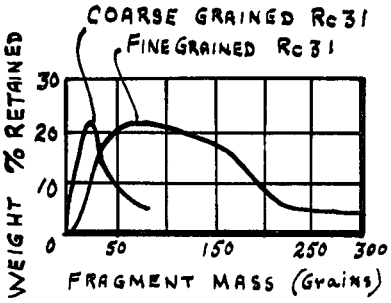
FIGS. 9 to 11 are graphical representations showing the effects of embrittlement, grain size and hardness on the fragmentation characteristics of this invention.
Figure 8:
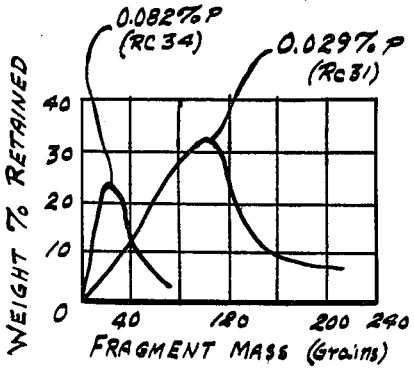
Figure 11:
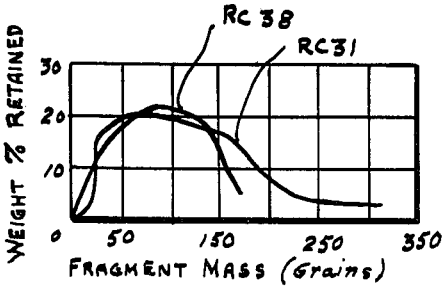
Figure 9:
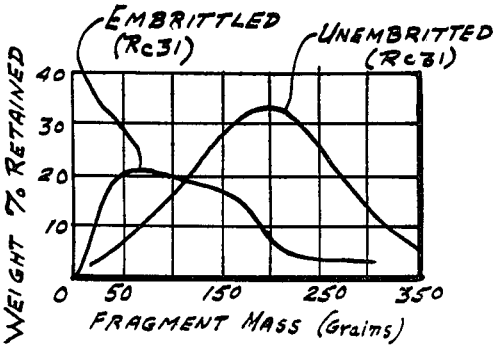

The graphical representations in the drawings illustrate the fragment distribution effects achieved by the alloys of the invention. FIGS. 1 to 8 show the effects of a low phosphorus content of 0.029 percent and a high phosphorus content of 0.082 percent on fragment mass distribution. FIGS. 1, 3, 5, and 7 illustrate alloys having a fine grain while FIGS. 2, 4, 6 and 8 are coarse grained. FIGS. 3, 4, 7 and 8 show low hardnesses ratings of 31 and 34 $R_c$ while FIGS. 1, 2, 5 and 6 show high hardnesses of 38, 39, 41, and 42 $R_c$. FIG. 9 shows the effects of temper brittleness on the fragment mass distribution of a fine grained, low phosphorus, low hardness alloy heat treated at 1100° F. FIG. 10 shows the effects of grain size on the fragment mass distribution of a low phosphorus, low hardened, embrittled alloy heat treated at 1100° F. FIG. 11 shows the effects of hardness on the fragment mass distribution of a fine grained, low phosphorus embrittled alloy heat treated at 1100° F.

From an examination of the above results, it can be seen that the present invention provides a technique which permits the simple production of military warheads having the high degree of fragmentation required for effective utilization against military targets. By utilizing and properly selecting the control variables discussed herein, warheads for both light and heavy targets can be obtained.

While the principles of this invention have been described with particularity, it should be understood that various alterations and modification can be made without departing from the spirit of the invention, the scope of which is defined by the appended claims.

What is claimed is:

1. A fragmentation type steel alloy consisting essentially of by weight about 0.029 to 0.082 percent phosphorus; about 0.5 percent carbon; about 1.5 percent manganese; about 1.5 percent chromium; about 0.15 percent vanadium; about 0.4 percent silicon; and the balance substantially all iron.

2. An alloy in accordance with claim 1 containing 0.029 weight percent phosphorus.

3. An alloy in accordance with claim 1 containing 0.082 weight percent phosphorus.

* * * * *